US011163242B2

(12) United States Patent
Yamashita

(10) Patent No.: US 11,163,242 B2
(45) Date of Patent: Nov. 2, 2021

(54) IMAGE FORMING APPARATUS

(71) Applicant: TOSHIBA TEC KABUSHIKI KAISHA, Tokyo (JP)

(72) Inventor: Daisuke Yamashita, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 225 days.

(21) Appl. No.: 16/567,702

(22) Filed: Sep. 11, 2019

(65) Prior Publication Data

US 2021/0070569 A1 Mar. 11, 2021

(51) Int. Cl.
*G03G 15/01* (2006.01)

(52) U.S. Cl.
CPC ..... *G03G 15/0189* (2013.01); *G03G 2215/00151* (2013.01)

(58) Field of Classification Search
CPC ..... G03G 15/0189; G03G 2215/00151; G03G 2215/00139; G03G 2215/00143
See application file for complete search history.

(56) References Cited

U.S. PATENT DOCUMENTS 6,160,978 A * 12/2000 Tsuruoka ..... G03G 15/755 399/165
7,136,611 B1 * 11/2006 Murase ..... G03G 15/1615 399/165
8,032,051 B2 * 10/2011 Takiguchi ..... G03G 15/161 399/101
8,433,225 B2 * 4/2013 Michibata ..... G03G 15/161 399/302
9,840,387 B2 * 12/2017 Shigihara ..... B65H 5/025
2007/0151829 A1 * 7/2007 Kim ..... B65G 15/64 198/809
2016/0070210 A1 * 3/2016 Seko ..... G03G 15/162 399/313
2016/0282770 A1 * 9/2016 Seko ..... G03G 15/1615
2016/0313677 A1 * 10/2016 Oyama ..... G03G 15/1615

FOREIGN PATENT DOCUMENTS

JP 05303314 A * 11/1993
JP 2012-163987 A 8/2012

* cited by examiner

*Primary Examiner* — Michael McCullough
(74) *Attorney, Agent, or Firm* — Kim & Stewart LLP

(57) ABSTRACT

An image forming apparatus includes a first roller having a first portion between tapered portions, which are at each end of the first portion. An outer diameter of each tapered portion decreases with distance from the first portion along a width direction of the first roller. A second roller has a second portion facing the first portion of the first roller and third portions, which are at each end of the second portion. The third portions face the tapered portions of the first roller. A belt of the image forming apparatus has an inner surface contacting the first portion of the first roller and an outer surface forming a nip with the second portion of the second roller. The belt has a protruding portion on the inner surface at each end of the belt in the width direction. The protruding portions face the tapered portions of the first roller.

20 Claims, 3 Drawing Sheets

IMAGE FORMING APPARATUS

FIELD

Embodiments described herein relate generally to an image forming apparatus.

BACKGROUND

An image forming apparatus includes a transfer belt and a transfer roller in contact with the transfer belt. The transfer roller transfers a toner image formed on the transfer belt onto a sheet. However, during operation, the position of the transfer belt shifts or deviates with respect to position of the transfer roller in the axial direction. It would be desirable for the transfer belt to maintain position without deviation during operation.

DETAILED DESCRIPTION

Figure 1:
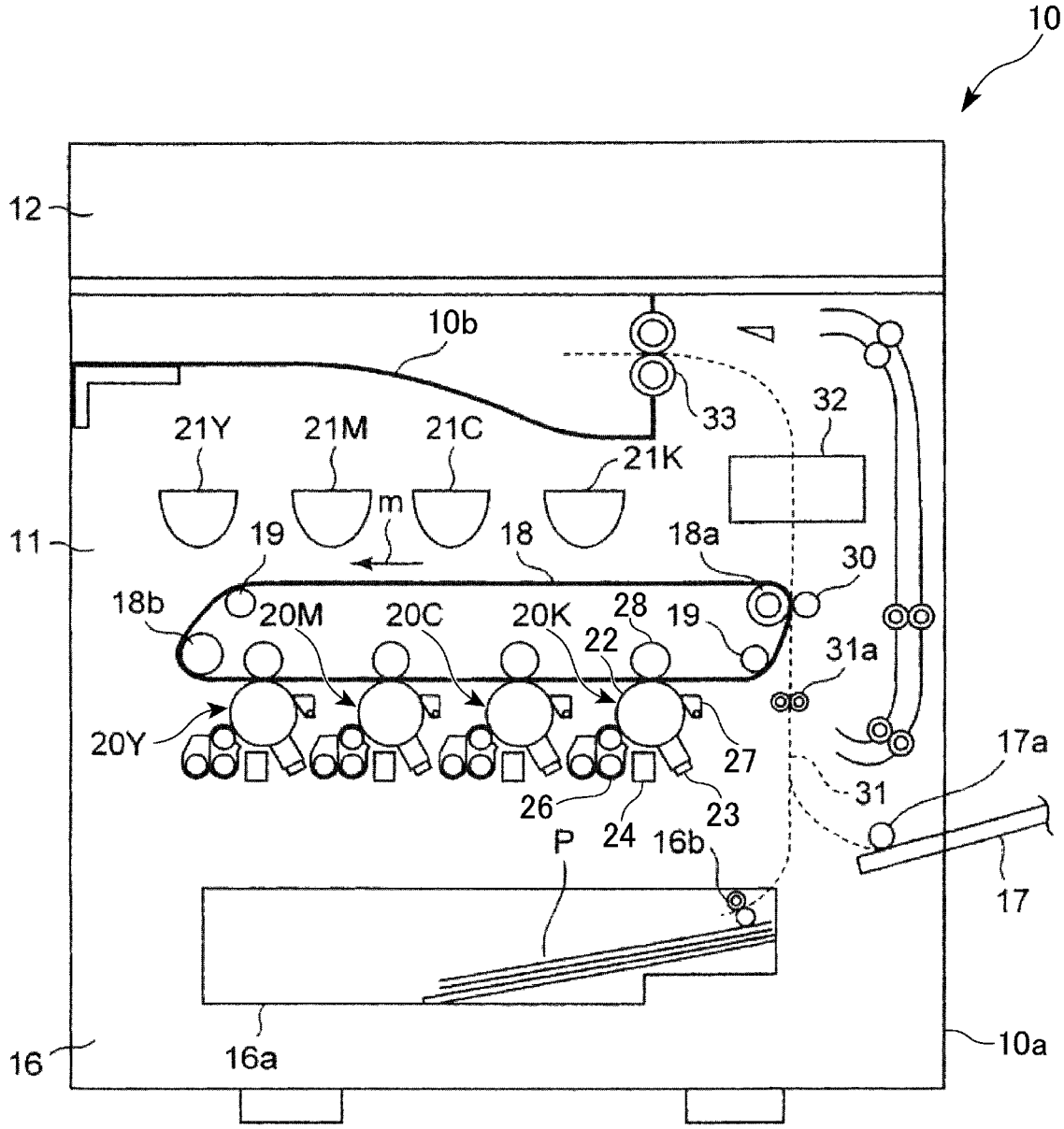
FIG. 1 is a configuration diagram of an image forming apparatus according to an embodiment.

According to one embodiment, an image forming apparatus includes a first roller, a second roller, and a belt. The first roller has a first portion between tapered portions, which are at each end of the first portion in a width direction. An outer diameter of each tapered portion decreases with distance from the first portion along the width direction. The second roller has a second portion that faces the first portion of the first roller and third portions, which are at each end of the second portion in the width direction. The third portions of the second roller face the tapered portions of the first roller. The belt has an inner surface contacting the first portion of the first roller and an outer surface forming a nip with the second portion of the second roller. The belt has a protruding portion on the inner surface at each end of the belt in the width direction. The protruding portions face the tapered portions of the first roller.

Examples of an image forming apparatus are described below with reference to the drawings. In the figures, the same components are denoted by the same reference numerals and symbols. In the figures, for clarity of explanation, dimensions of various elements may be exaggerated or varied and shapes of various may be presented in a simplified manner.

FIG. 1 is a diagram of an image forming apparatus 10 according to an embodiment. As illustrated in FIG. 1, the image forming apparatus 10 includes, on the inside of a housing 10*a*, a printer section 11, a scanner section 12, a cassette paper feeding section 16, and a manual paper feeding section 17.

The printer section 11 is an image forming section and includes image forming stations 20Y, 20M, 20C, and 20K of Y (yellow), M (magenta), C (cyan), and K (black). The image forming stations 20Y, 20M, 20C, and 20K are disposed along an intermediate transfer belt 18. The printer section 11 includes supply cartridges 21Y, 21M, 21C, and 21K respectively above the image forming stations 20Y, 20M, 20C, and 20K.

Each of the four image forming stations 20Y, 20M, 20C, and 20K includes a photoconductive drum 22, an electrostatic charger 23, an exposure scanning head 24, a developing device 26, and a photoconductive cleaner 27. The developing devices 26 of the image forming stations 20Y, 20M, 20C, and 20K respectively include two-component developers including toners of Y (yellow), M (magenta), C (cyan), and K (black) and a carrier.

The printer section 11 includes a backup roller 18*a*, a driven roller 18*b*, a tension roller 19, the intermediate transfer belt 18, a plurality of primary transfer rollers 28, and a secondary transfer roller 30. The backup roller 18*a*, the driven roller 18*b*, and the tension roller 19 support the intermediate transfer belt 18. The intermediate transfer belt 18 rotates in an arrow m direction. The primary transfer rollers 28 are opposed to the photoconductive drums 22 via the intermediate transfer belt 18.

The secondary transfer roller 30 is opposed to the backup roller 18*a* via the intermediate transfer belt 18. In some context, the backup roller 18*a* may be referred to as a first rotating body and the secondary transfer roller 30 may be referred to as a second rotating body.

The cassette paper feeding section 16 is provided below the printer section 11. The cassette paper feeding section 16 includes a paper feeding cassette 16*a* and a pickup roller 16*b*. The paper feeding cassette 16*a* stores sheets P. The pickup roller 16*b* takes out the sheets P from the paper feeding cassette 16*a*. The manual paper feeding section 17 includes a paper feeding roller 17*a*. The sheet P supplied from the cassette paper feeding section 16 or the manual paper feeding section 17 is conveyed along a conveying path 31. The printer section 11 includes a registration roller 31*a*, a fixing device 32, and a paper discharge roller pair 33. The registration roller 31*a*, the secondary transfer roller 30, the fixing device 32, and the paper feeding roller pair 33 are provided on the conveying path 31.

The primary transfer rollers 28 transfer toner images formed on the photoconductive drums 22 to the intermediate transfer belt 18. This is referred to as a primary transfer of the toner image. The primary transfer rollers 28 of the image forming stations 20Y, 20M, 20C, and 20K sequentially deposit toner images of Y (yellow), M (magenta), C (cyan), and K (black) superimposed on one another to form a color toner image on the intermediate transfer belt 18.

The secondary transfer roller 30 rotates with the intermediate transfer belt 18. The secondary transfer roller 30 transfers the color toner image on the intermediate transfer belt 18 to a sheet P fed along the conveying path 31. The transfer of the toner image from the intermediate transfer belt 18 to the sheet P is referred to as a secondary transfer.

The structures of the backup roller 18*a*, the intermediate transfer belt 18, and the secondary transfer roller 30 are described below.

Figure 2:
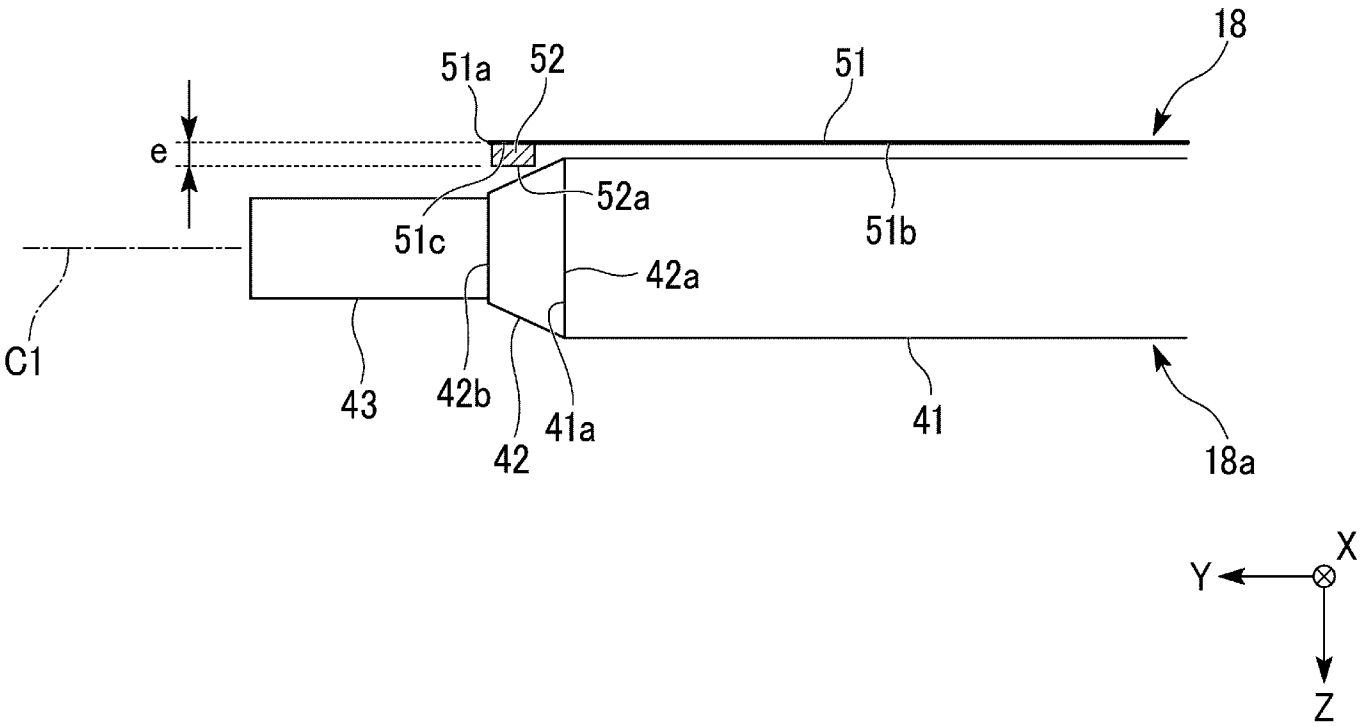
FIG. 2 illustrates an enlarged view of a part of a backup roller and an intermediate transfer belt.
Figure 3:
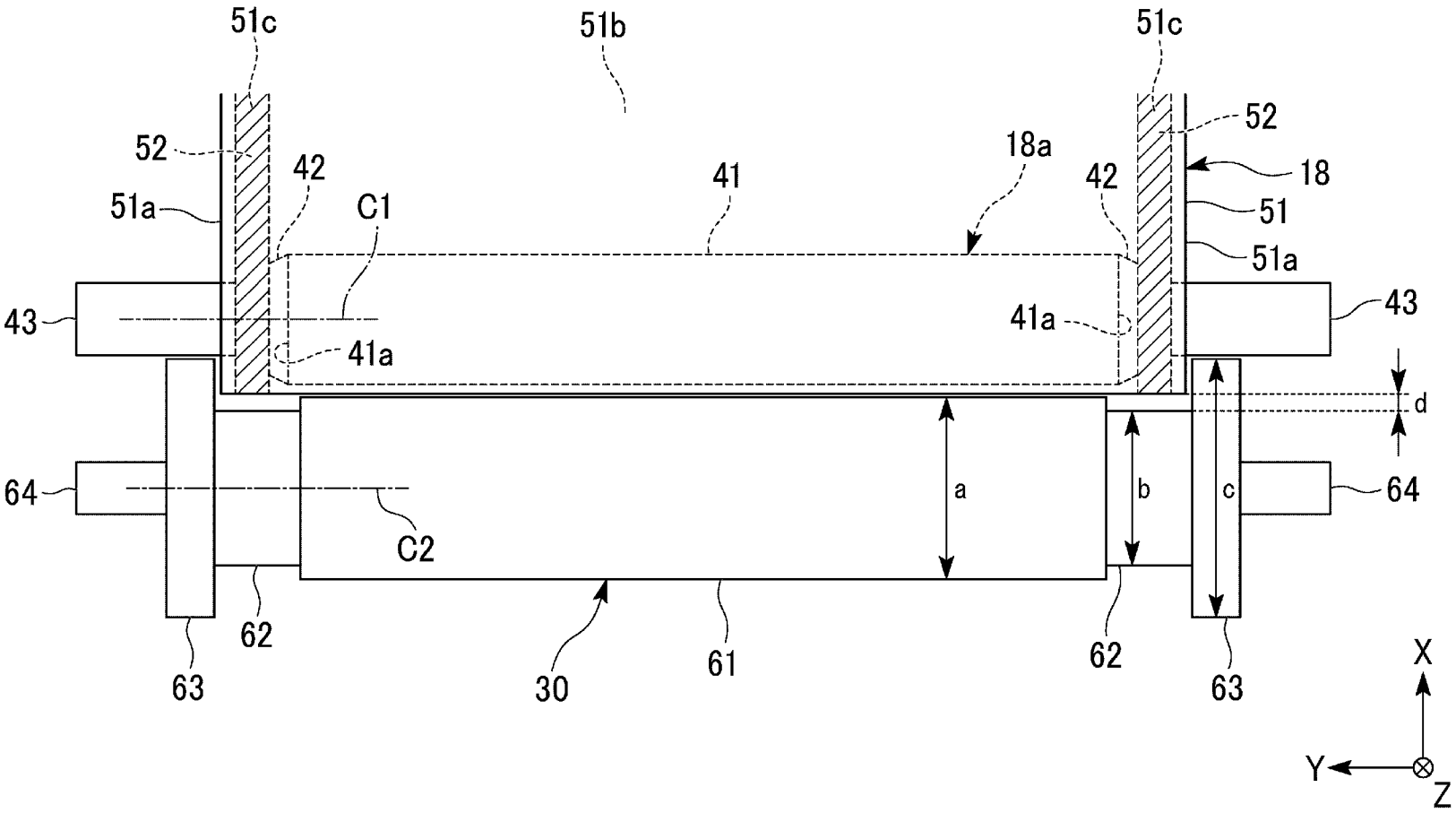
FIG. 3 illustrates a plan view of a backup roller, an intermediate transfer belt, and a secondary transfer roller.

FIG. 2 illustrates an enlarged view of a part of the backup roller 18*a* and the intermediate transfer belt 18. FIG. 3 illustrates a plan view of the backup roller 18*a*, the intermediate transfer belt 18, and the secondary transfer roller 30.

As illustrated in FIGS. 2 and 3, the backup roller 18*a* includes a first main section 41, a pair of reducing diameter sections 42 (one on each end of the first main section 41 in the Y-direction), and a pair of extended shaft sections 43 (one on each end of the first main section 41 in the Y-direction) (see FIG. 3). The first main section 41 is formed in a columnar or cylindrical shape. A line C1 indicates the center axis of the first main section 41. The line C1 is referred to below as center axis C1. The center axis C1 is parallel to the Y-direction. The first main section 41 has a circular shape in a cross section taken orthogonal to the center axis C1 direction. The first main section 41 has a fixed outer diameter. For example, a surface layer section of the first main section 41 can be made of a metal material such as stainless steel (SUS) or a free-cutting steel material (SUM). The surface layer section of the first main section 41 may have a structure in which a coating made of rubber, resin, or the like is formed on the outer circumferential surface of a base body made of a metal material.

The reducing diameter section 42 extends from an end portion 41*a* of the first main section 41 in a direction along the center axis C1 away from the first main section 41 while decreasing in diameter in a taper shape. The reducing diameter section 42 is formed in a truncated cone shape decreasing in an outer diameter from a proximal end 42*a* (adjacent to the end portion 41*a*) toward a distal end 42*b*. The outer diameter of the proximal end 42*a* is substantially the same as the outer diameter of the first main section 41. The center axis of the reduced diameter section 42 coincides with the center axis C1 of the first main section 41. At least a surface layer section of the reduced diameter section 42 is made of resin or the like. The pair of reducing diameter sections 42 are respectively provided at both end portions 41*a* of the first main section 41 (see FIG. 3).

The extended shaft section 43 extends from the proximal end 42*a* of the reducing diameter section 42 in the center axis C1 direction (the center axis C1 direction outer side; a direction away from the reducing diameter section 42). The extended shaft section 43 is formed in a cylindrical or columnar shape. The extended shaft section 43 is formed in a circular shape in a cross section orthogonal to the center axis direction (the Y direction). The extended shaft section 43 has a fixed outer diameter. The outer diameter of the extended shaft section 43 is substantially the same as the outer diameter of the distal end 42*b* of the reducing diameter section 42 or smaller than the outer diameter of the distal end 42*b*. The center axis of the extended shaft section 43 coincides with the center axis C1 of the first main section 41. The extended shaft section 43 is formed on an end portion side (the opposite side of the first main section 41 side) with respect to the reducing diameter section 42. One of the extended shaft sections 43 is respectively provided at each of the distal ends of the reducing diameter sections 42 (see FIG. 3).

The backup roller 18*a* may have a structure in which the first main section 41 and the reducing diameter section 42 are provided on the outer circumferential surface of a shaft core section (not illustrated in FIG. 2). The extended shaft section 43 may be a part of the shaft core section.

As illustrated in FIG. 1, the intermediate transfer belt 18 is wound on the backup roller 18*a*, the driven roller 18*b*, and the tension roller 19. As illustrated in FIGS. 2 and 3, the intermediate transfer belt 18 includes a belt main body (a belt) 51 and a pair of restricting projecting sections (projecting sections) 52 and 52.

As illustrated in FIG. 2, the belt main body 51 is configured by a sheet having flexibility. The belt main body 51 is formed in an endless shape. The belt main body 51 is made of resin or the like. A direction perpendicular to the paper surface in FIG. 2 is the length direction of the belt main body 51. This direction is referred to as "X direction". The left-right direction in FIG. 2 is a direction along the center axis C1 of the backup roller 18*a* and is the width direction of the belt main body 51. This direction is referred to as "Y direction". The Y direction is a direction orthogonal to the X direction. The up-down direction in FIG. 2 is a Z direction orthogonal to the X direction and the Y direction.

The inner circumferential surface of the belt main body 51 includes a main region 51*b* and a pair of side regions 51*c* (see FIG. 3). The main region 51*b* is a belt region having fixed width including the central portion of the belt main body 51 in the width direction (the Y direction) of the inner circumferential surface of the belt main body 51. The main region 51*b* faces the first main section 41 of the backup roller 18*a*. The main region 51*b* is in contact with the outer circumferential surface of the first main section 41. The side regions 51*c* are belt regions having fixed width including the width direction end portions 51*a* of the belt main body 51 in the inner circumferential surface of the belt main body 51. The side regions 51*c* and 51*c* are regions on one side and the other side in the width direction (the Y direction) of the main region 51*b*. At least parts of each of the side regions 51*c* face the reducing diameter sections 42 of the backup roller 18*a*.

The restricting projecting section 52 is formed on the inner circumferential surface of the belt main body 51. The restricting projecting section 52 projects inward from the inner circumferential surface of the belt main body 51. The projecting direction of the restricting projecting section 52 corresponds to the thickness direction of the belt main body 51 (the Z direction in FIG. 2). As illustrated in FIG. 3, the restricting projecting sections 52 are formed close to the width direction end portions 51*a* as viewed from the Z direction. Therefore, the main region 51*b* facing the first main section 41 can be wide.

The restricting projecting section 52 is formed continuously along the length of the belt main body 51. The restricting projecting section 52 desirably extends over the entire length of the belt main body 51. When the restricting projecting section 52 is continuous in the length direction of the belt main body 51, it is possible to reduce deviations or shifting in the width direction of the intermediate transfer belt 18.

As illustrated in FIG. 2, the restricting projecting section 52 is formed having a rectangular shape in a cross section (a YZ cross section) orthogonal to the X direction. That is, the YZ cross section of the restricting projecting section 52 has a rectangular shape in this example. A dimension (width) in the Y direction of the restricting projecting section 52 is larger than a dimension (height) "e" in the Z direction of the restricting projecting section 52. For example, the restricting projecting section 52 is made of rubber, resin, or the like. The restricting projecting section 52 is in a position facing the reducing diameter section 42.

The restricting projecting section 52 is formed to project from the inner circumferential surface of the belt main body 51. Therefore, the restricting projecting section 52 is in a position where the restricting projecting section 52 can come into contact with the outer surface of the reducing diameter section 42. The restricting projecting section 52 restricts the intermediate transfer belt 18 from moving in the width direction (the Y direction). For example, in FIG. 2, the inner side edge of an inner circumferential surface 52*a* of the restricting projecting section 52 is in a position where the inner edge can come into contact with the outer surface of the reducing diameter section 42. Therefore, the intermediate transfer belt 18 is restricted from moving towards the righthand page direction in FIG. 2, that is, a direction from the width direction end portion 51*a* toward the width direction (Y direction) center of the belt main body 51.

As illustrated in FIG. 3, in the intermediate transfer belt 18, the restricting projecting sections 52 are respectively formed for both the side regions 51*c*. Therefore, the restricting projecting sections 52 are respectively in positions to come into contact with the reducing diameter sections 42 of the backup roller 18*a*. Therefore, the intermediate transfer belt 18 is restricted from moving in both directions along the width direction (the Y direction) (that is, the righthand page direction and the left-hand page direction in FIG. 3).

The secondary transfer roller 30 includes a second main section 61, an intermediate body section 62, a movement restricting section 63, and an extended shaft section 64. The second main section 61 is formed in a cylindrical or columnar shape. The line C2 indicates the center axis of the second main section 61 and is referred to as the center axis C2. The second main section 61 has a circular shape in a cross section orthogonal to the center axis C2 direction. The second main section 61 has a fixed outer diameter. At least a surface layer section of the second main section 61 is desirably made of an elastically deformable material. At least the surface layer section of the second main section 61 is made of resin (e.g., foamed resin), rubber, or the like. Examples of the resin include polyurethane, polystyrene, and polyolefin (polyethylene, polypropylene, etc.). If a foamed resin (also sometimes referred to as foam rubber) is used, a mechanical characteristic of the second main section 61 may be improved.

The second main section 61 may be compression-deformable, when pressed by the belt main body 51 or the like, in a direction in which the outer diameter of the second main section 61 decreases. For example, hardness value of a durometer type A reading (conforming to Japanese Industrial Standards (JIS) K6253-3 or JIS K7215) of at least the surface layer section of the second main section 61 is in a range of 30 to 90.

The second main section 61 is opposed to the first main section 41 of the backup roller 18*a* via the belt main body 51.

The intermediate body section 62 extends from an end portion 61*a* of the second main section 61 in a direction along the center axis C2 away from the second main section 61. The intermediate body section 62 is formed in a cylindrical or columnar shape. The intermediate body section 62 is formed in a circular shape in a cross section orthogonal to the center axis direction (the Y direction). The intermediate body section 62 has a fixed outer diameter. The center axis of the intermediate body section 62 coincides with the center axis C2.

The surface hardness of the intermediate body section 62 is higher than the surface hardness of the second main section 61. Examples of methods for determining hardness include durometer type A (conforming to JIS K6253-3 or JIS K7215) values and Rockwell hardness (conforming to JIS K7202). For example, at least a surface layer of the intermediate body section 62 is made of resin. Examples of the resin include polyolefin (polyethylene, polypropylene, etc.) and polystyrene.

The intermediate body section 62 may have the same diameter as the diameter of the second main section 61. However, the intermediate body section 62 is desirably formed to have a diameter smaller than the diameter of the second main section 61. That is, an outer diameter "a" of the second main section 61 and an outer diameter "b" of the intermediate body section 62 desirably satisfy the following Expression (1):

$$b<a \quad (1)$$

If the outer diameter "b" of the intermediate body section 62 is smaller than the outer diameter "a" of the second main section 61, the intermediate body section 62 having a high hardness will less easily come into contact with the belt main body 51. Therefore, breakage of the belt main body 51 will occur less easily.

At least a part of the outer circumferential surface of the intermediate body section 62 is opposed to the restricting projecting section 52 via the belt main body 51. The intermediate body section 62 may be separated from the belt main body 51. If the intermediate body section 62 is separated from the belt main body 51, a gap between the outer circumferential surface of the intermediate body section 62 and the outer circumferential surface of the belt main body 51 is referred to as gap "d". The gap "d" and the height "e" of the restricting projecting section 52 desirably satisfy the Expression (2) below. The gap "d" is the gap between the belt main body 51 and the intermediate body section 62 where the belt main body 51 and the intermediate body section 62 are opposed to each other.

$$0<d<e \quad (2)$$

When the gap "d" is greater than 0, the belt main body 51 less easily comes into contact with the intermediate body section 62 even if the restricting projecting section 52 of the intermediate transfer belt 18 runs onto the reducing diameter section 42 of the backup roller 18*a*. Therefore, breakage of the belt main body 51 is less likely to occur. Accordingly, it is possible to improve durability of the intermediate transfer belt 18.

If the gap "d" is smaller than the height "e" of the restricting projecting section 52, it is possible to restrict the restricting projecting section 52 from climbing over the reducing diameter section 42 to reach the first main section 41.

The movement restricting sections 63 are formed in a cylindrical or columnar shape. Each movement restricting section 63 has a circular shape in a cross section orthogonal to the center axis direction (the Y direction). The movement restricting sections 63 have a diameter larger than the diameter of the second main sections 61. That is, an outer diameter "c" of the movement restricting section 63 is larger than the outer diameter "a" of the second main section 61. The center axis of the movement restricting section 63 coincides with the center axis C2. The movement restricting sections 63 are provided on the end portion sides beyond the intermediate body sections 62 in the width direction. For example, at least a surface layer section of a movement restricting section 63 is made of a resin material. The movement restricting sections 63 are in a position opposed to the extended shaft sections 43.

When a movement restricting section 63 comes into contact with the extended shaft section 43, the movement restricting section 63 can prevent the second transfer roller 30 from moving in a direction which approaches the backup roller 18*a*. Therefore, the movement restricting section 63 restricts the backup roller 18*a* and the secondary transfer roller 30 from approaching/contacting each other excessively. Therefore, it is possible to limit the pressing force applied to the intermediate transfer belt 18 by the secondary transfer roller 30. Accordingly, it is possible to improve durability of the intermediate transfer belt 18.

The outer diameter "a" of the second main section 61, the outer diameter "b" of the intermediate body section 62, and the outer diameter "c" of the movement restricting section 63 desirably satisfy the following Expression (3):

$$b<a<c \quad (3)$$

As described above, if the outer diameter "b" of the intermediate body section 62 is less than the outer diameter "a" of the second main section 61, the hard intermediate body section 62 will less easily come into contact with the belt main body 51. Therefore, breakage of the belt main body 51 occurs less easily.

If the outer diameter "c" of the movement restricting section 63 is larger than the outer diameter "a" of the second main section 61 and the movement restricting section 63 comes into contact with the extended shaft section 43, it is possible to restrict the secondary transfer roller 30 from moving in a direction which approaches the backup roller 18*a*.

The extended shaft section 64 extends from the outer end surface of the movement restricting section 63 in the center axis C2 direction (the center axis C2 direction outer side; a direction away from the movement restricting section 63).

The extended shaft section 64 is formed in a cylindrical or columnar shape. The extended shaft section 64 is formed in a circular shape in a cross section orthogonal to the center axis direction (the Y direction). The extended shaft section 64 has a diameter smaller than the diameter of the second main section 61. The extended shaft section 64 is formed in an end portion side (the opposite side of the second main section 61 side) with respect to the movement restricting section 63.

The secondary transfer roller 30 may have a structure in which the second main section 61, the intermediate body section 62, and the movement restricting section 63 are provided on the outer circumferential surface of a shaft core section. The extended shaft section 64 may be a part of this shaft core section.

The secondary transfer roller 30 is pressed by a mechanical urging member, such as a spring, towards the backup roller 18*a* and the intermediate transfer belt 18. Therefore, the second main section 61 in a portion pressed by the intermediate transfer belt 18 may be deformed by compression that acts to decrease the outer diameter of the second main section 61. Consequently, it is possible to increase a contact area of the intermediate transfer belt 18, the sheet P, and the secondary transfer roller 30. Therefore, it is possible to prevent or reduce transfer failures of toner images and form a satisfactory image on the sheets P.

The image forming apparatus 10 forms a toner image on the sheet P in the printer section 11 according to image data received from the scanner section 12 or the like and discharges the sheet P to a paper discharge tray 10*b*. For example, the image forming apparatus 10 is a color MFP (Multi-Function Peripheral).

Traveling of the intermediate transfer belt 18 is sometimes affected by a setting posture of the image forming apparatus 10, inclinations of the backup roller 18*a* and the tension roller 19, outer diameter profiles of the backup roller 18*a* and the tension roller 19, the stretching and suspension balance of the intermediate transfer belt 18, and the like. Although the intermediate transfer belt 18 includes the restricting projecting section 52, if the restricting projecting section 52 runs onto the reducing diameter section 42, it is assumed that positional deviation in the width direction (the Y direction) occurs with the intermediate transfer belt 18.

In the image forming apparatus 10, the secondary transfer roller 30 includes the second main section 61 opposed to the first main section 41 of the backup roller 18*a* and the intermediate body section 62 opposed to the restricting projecting section 52 of the backup roller 18*a*. Therefore, even if the restricting projecting section 52 runs onto the reducing diameter section 42, it is possible to restrict, with the intermediate body section 62, the intermediate transfer belt 18 from moving in a direction in which the restricting projecting section 52 runs onto the reducing diameter section 42. Accordingly, it is possible to suppress deviations in the width direction (the Y direction) of the intermediate transfer belt 18 and cause the intermediate transfer belt 18 to stably operate.

In the image forming apparatus 10, the restricting projecting section 52 is continuously formed in the length direction of the belt main body 51. However, the configuration of the restricting projecting section 52 is not particularly limited in this regard. For example, the restricting projecting section may be discontinuously formed along the length direction of the belt main body. Specifically, the restricting projecting section may be a series of projecting sections intermittently formed along the length direction of the belt main body. In one example, the restricting projecting section 52 may be formed as a plurality of discrete dot-like structures projecting from the belt main body 51 along a row in the length direction of the belt main body 51.

The secondary transfer roller 30 in the image forming apparatus 10 includes the second main section 61, the intermediate body section 62, the movement restricting section 63, and the extended shaft section 64. However, in some examples, the secondary transfer roller 30 may not include the movement restricting section 63 and the extended shaft section 64. In such a case, the secondary transfer roller 30 includes just the second main section 61 and the body section 62.

The backup roller 18*a* in the image forming apparatus 10 includes the first main section 41, the reducing diameter section 42, and the extended shaft section 43. However, the backup roller 18*a* may not, in some examples, include the extended shaft section 43. In that case, the backup roller 18*a* includes just the first main section 41 and the reduced diameter section 42.

The restricting projecting sections 52 in the image forming apparatus 10 may be respectively formed close to the width direction end portions 51*a* as when viewed from the Z direction or may be formed in positions including or overlapping the width direction end portions 51*a*.

In some embodiments, the image forming apparatus 10 may be a monochrome image forming apparatus rather than a color image forming apparatus. The number of image forming stations is not a limitation. In general, the image forming apparatus 10 may include any number of printer sections and/or image forming stations.

The configuration of the intermediate transfer belt 18 described above may be applied to a transfer belt used in a printer section of a direct transfer type. The configuration of the intermediate transfer belt 18 described above also may be applied to a conveyance belt for conveying sheets.

According to at least one embodiment described above, the second rotating body includes the second main section opposed to the first main section of the first rotating body and the body section opposed to the projecting section. Therefore, even if the projecting section runs onto the reducing diameter section, it is possible to restrict, with the body section, movement of the belt in a direction in which the projecting section runs onto the reducing diameter section. Accordingly, it is possible to suppress deviations in the width direction of the belt and cause the belt to stably operate.

While certain embodiments have been described these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

a first roller having a first portion between tapered portions, which are at each end of the first portion in a width direction, an outer diameter of each tapered portion decreasing with distance from the first portion along the width direction;

a second roller having a second portion, facing the first portion of the first roller, and third portions, which are at each end of the second portion in the width direction and facing the tapered portions of the first roller; and a belt having an inner surface contacting the first portion of the first roller and an outer surface forming a nip with the second portion of the second roller, the belt having a protruding portion on the inner surface at each end of the belt in the width direction, the protruding portions facing the tapered portions of the first roller.

2. The image forming apparatus according to claim 1, wherein an outer diameter of the second portion is greater than an outer diameter of the third portions, and a distance between the outer surface of the belt and the third portion is less than a protrusion height of the protruding portions from the inner surface of the belt.

3. The image forming apparatus according to claim 1, wherein the second roller further includes fourth portions beyond the third portions in the width direction, an outer diameter of the fourth portions being greater than an outer diameter of the second portion.

4. The image forming apparatus according to claim 3, wherein a side surface of the fourth portions faces an outer edge of the belt in the width direction.

5. The image forming apparatus according to claim 1, wherein a surface hardness of the third portions is greater than a surface hardness of the second portion.

6. The image forming apparatus according to claim 1, wherein the second portion of the second roller comprises a foamed resin material.

7. The image forming apparatus according to claim 1, wherein the protruding portions extend continuously along the entire length of belt.

8. The image forming apparatus according to claim 1, wherein the second portion presses against the outer surface of the belt.

9. The image forming apparatus according to claim 1, wherein the protruding portions are adjacent to an outer edge of the belt.

10. The image forming apparatus according to claim 1, wherein the belt is a transfer belt.

11. The image forming apparatus according to claim 1, wherein the protruding portions of the endless belt are elastically deformable material.

12. The image forming apparatus according to claim 1, wherein a width of the protruding portions is less than a width of the tapered portions.

13. The image forming apparatus according to claim 1, wherein a width of the tapered portions is less than a width of the third portions.

14. The image forming apparatus according to claim 1, wherein the protruding portions have a rectangular cross-sectional shape.

15. An image forming apparatus, comprising:

a first roller having a first portion and a tapered portion at each outer end of the first portion in a width direction, an outer diameter of each tapered portion decreasing with distance from the first portion along the width direction;

a second roller having a second portion facing the first portion of the first roller, a third portion at each outer end of the second portion in the width direction and facing the tapered portions of the first roller, and a fourth portion at each outer end of the third portions in the width direction, the fourth portions having an outer diameter greater than the second portion, the second portion having an outer diameter greater third portions; and a belt having an inner surface contacting the first portion and an outer surface of the belt forming a nip with the second portion of the second roller, the belt having a protruding portion on the inner surface at each outer end in the width direction, the protruding portions facing the tapered portions of the first roller, the width of the belt in the width direction being less than a distance between the fourth portions of the second roller.

16. The image forming apparatus according to claim 15, wherein a distance between the outer surface of the belt and the third portion is less than a protrusion height of the protruding portions from the inner surface of the belt.

17. The image forming apparatus according to claim 15, wherein the second portion has an outer surface that is foamed resin material.

18. The image forming apparatus according to claim 17, wherein the first roller includes a shaft section at each outer end of the tapered portions in the width direction.

19. The image forming apparatus according to claim 15, wherein the protruding portions have a rectangular cross-sectional shape.

20. The image forming apparatus according to claim 15, wherein the protruding portions extend continuously along the entire length of the belt.

* * * * *